US008753028B1

(12) United States Patent
Toscani et al.

(10) Patent No.: US 8,753,028 B1
(45) Date of Patent: Jun. 17, 2014

(54) RING BINDER WITH INTERCHANGEABLE BINDER COVERS

(71) Applicants: Gerry Toscani, Moorestown, NJ (US); Micah L. Maraia, Menomonie, WI (US)

(72) Inventors: Gerry Toscani, Moorestown, NJ (US); Micah L. Maraia, Menomonie, WI (US)

(73) Assignee: Paris Business Products, Inc., Westampton, NJ (US)

( * ) Notice: Subject to any disclaimer, the term of this patent is extended or adjusted under 35 U.S.C. 154(b) by 10 days.

(21) Appl. No.: 13/746,385

(22) Filed: Jan. 22, 2013

(51) Int. Cl.
*B42F 13/00* (2006.01)

(52) U.S. Cl.
USPC ..... 402/75

(58) Field of Classification Search
CPC ..... B42F 13/0066
USPC ..... 402/75
See application file for complete search history.

(56) References Cited

U.S. PATENT DOCUMENTS

| | | | | | |
|---|---|---|---|---|---|
| 1,669,432 | A * | 5/1928 | Trussell | ..... | 402/73 |
| 1,807,390 | A * | 5/1931 | Crosby | ..... | 402/75 |
| 2,068,229 | A * | 1/1937 | Fahrnbuhl | ..... | 402/29 |
| 3,175,847 | A * | 3/1965 | McKowen | ..... | 402/75 |
| 4,765,768 | A * | 8/1988 | Wright | ..... | 402/75 |
| 2012/0170968 | A1 * | 7/2012 | Henderson et al. | ..... | 402/75 |

* cited by examiner

*Primary Examiner* — Kyle Grabowski
(74) *Attorney, Agent, or Firm* — Stuart M. Goldstein

(57) ABSTRACT

A ring binder has a standard ring assembly having a ring base and upstanding rings, a ring assembly support having a plurality of indents positioned along its sides, a binder connector having a plurality of upstanding tabs, and a plurality of binder covers each having a center spine with a plurality of slots configured to accept each of the plurality of binder connector tabs. The ring binder is assembled by the insertion of the binder connector tabs into slots of the binder cover and then into the indents of the ring assembly support. The ring binder can be sold assembled or as a kit, which would include a plurality of interchangeable binder covers.

10 Claims, 5 Drawing Sheets

RING BINDER WITH INTERCHANGEABLE BINDER COVERS

FIELD OF THE INVENTION

This invention relates to ring binders, and more particularly to ring binders consisting of individual components which are readily assembled and disassembled to permit the use of interchangeable binders and to allow for more efficient and economical packaging and shipment of binders.

BACKGROUND OF THE INVENTION

Ring binders are usually manufactured and shipped as integral units, with their binder covers and ring assemblies assembled and permanently connected. As a result, once binder covers become worn, the entire binder is discarded. In addition, the packaging and shipment of assembled binders from manufacturer to the wholesaler or retail store is increasingly expensive, given the bulk volume of the many assembled ring binders which are transported in boxed containers.

SUMMARY OF THE INVENTION

It is thus the object of the present invention to provide a ring binder which overcomes the disadvantages and limitations of prior ring binder and ring binder assemblies.

It is the object of the present invention to provide a ring binder with the ability to utilize interchangeable binder covers and a single ring assembly.

It is another object of the present invention to provide a ring binder which utilizes a unique binder cover to ring assembly connection, thus permitting different binder covers to be utilized with the same ring assembly.

It is a further object of the present invention to provide a ring binder with components, including a plurality of binder covers, which can be easily, efficiently, and economically packaged and transported for sale and distribution.

These and other objects are accomplished by the present invention, a ring binder comprising a standard ring assembly having a ring base and upstanding rings, a ring assembly support having a plurality of indents positioned along its sides, a binder connector having a plurality of upstanding tabs, and a plurality of binder covers each having a center spine with a plurality of slots configured to accept each of the plurality of binder connector tabs. The ring binder is assembled by the insertion of the binder connector tabs into slots of the binder cover and then into the indents of the ring assembly support. The ring binder can be sold assembled or as a kit, which would include a plurality of interchangeable binder covers.

The novel features which are considered as characteristic of the invention are set forth in particular in the appended claims. The invention, itself, however, both as to its design, construction and use, together with additional, features and advantages thereof, are best understood upon review of the following detailed description with reference to the accompanying drawings.

DETAILED DESCRIPTION OF THE INVENTION

Figure 1:
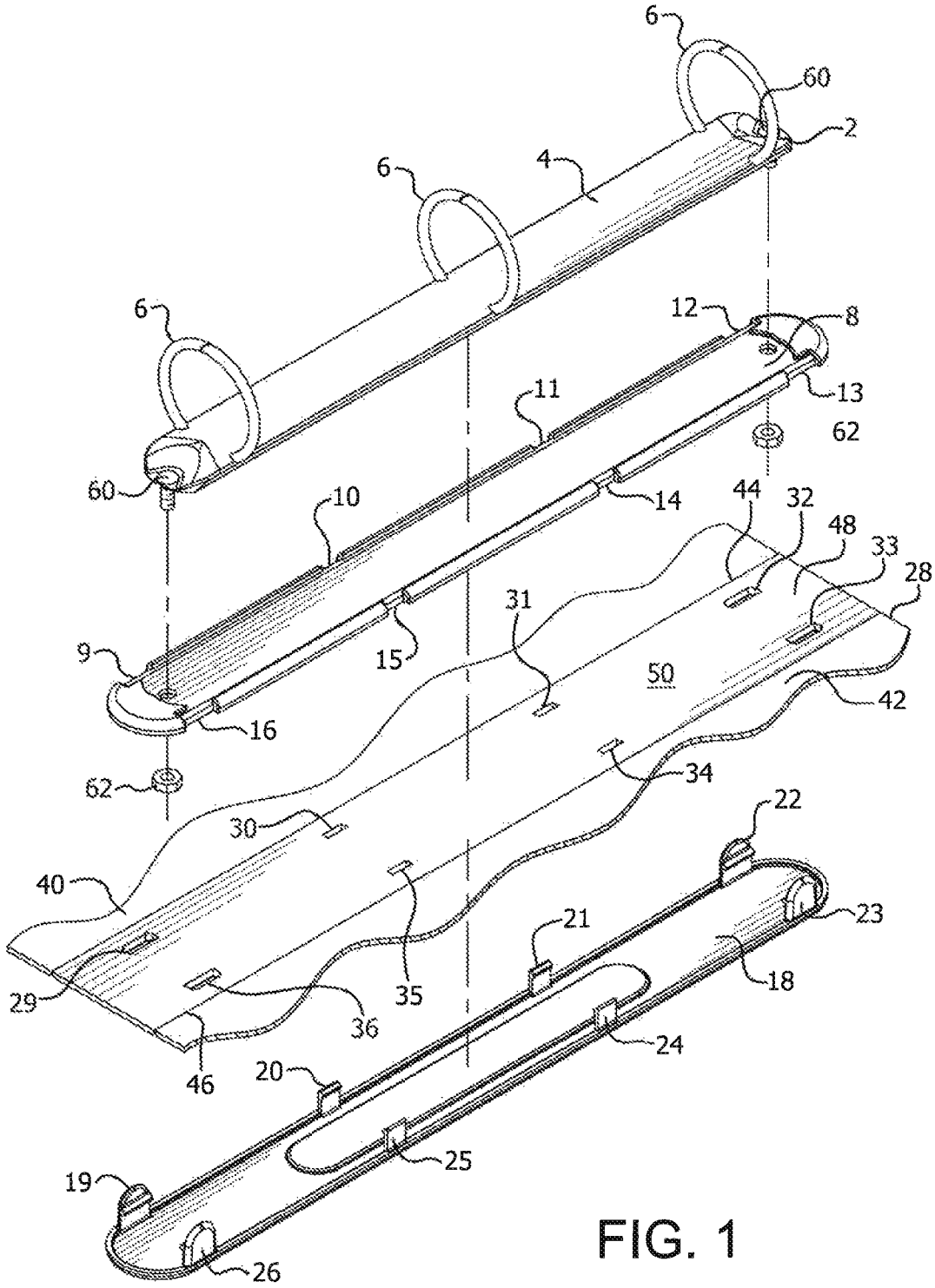
FIG. 1 is an exploded isometric view of the components of the ring binder of the present invention.
Figure 2:
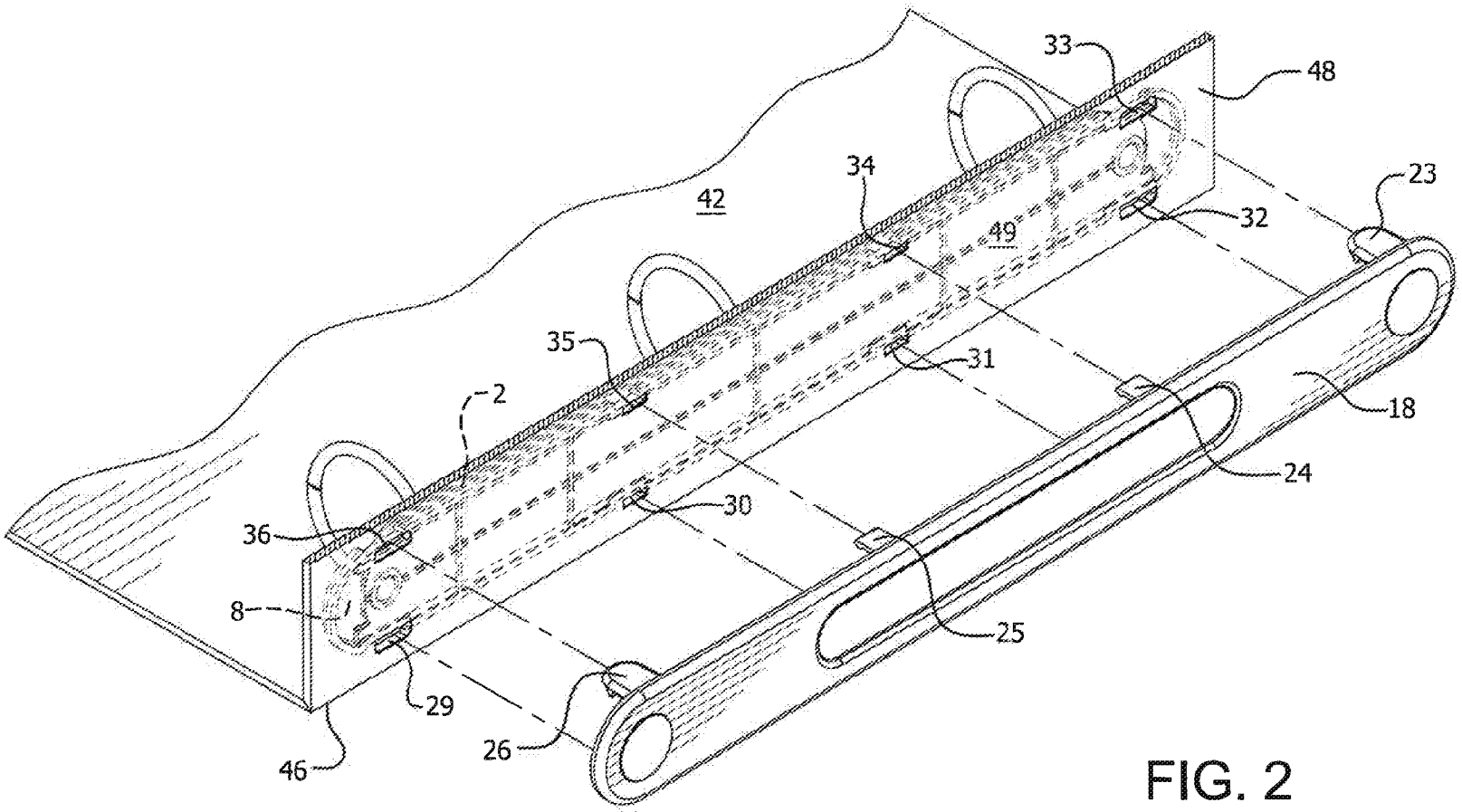
FIG. 2 is an exploded perspective view of the ring binder of the present invention partially broken away to show how parts are to be assembled onto the binder cover.
Figure 3:
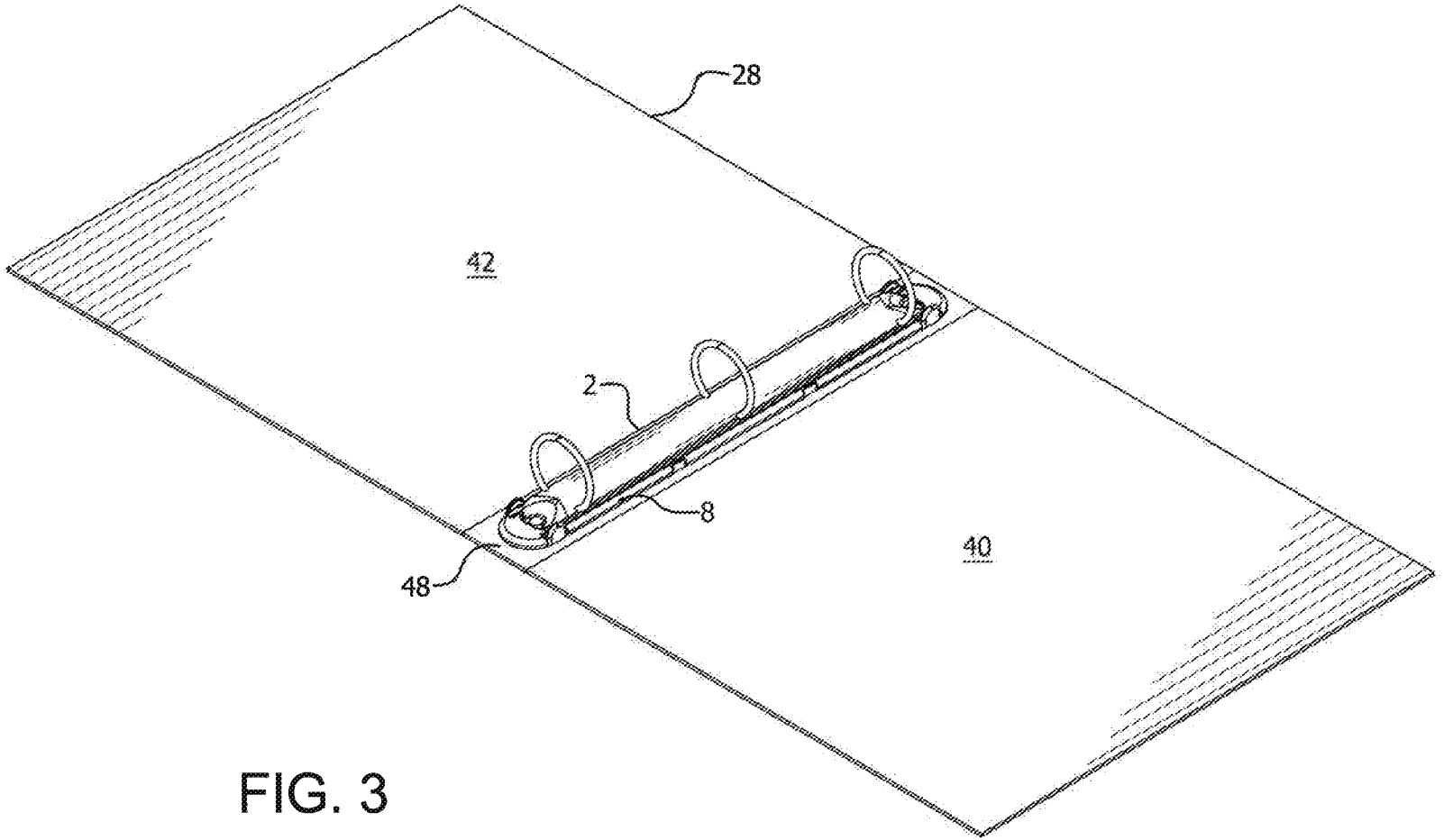
FIG. 3 is an assembled view of the ring binder of the present invention in a fully open position.
Figure 4:
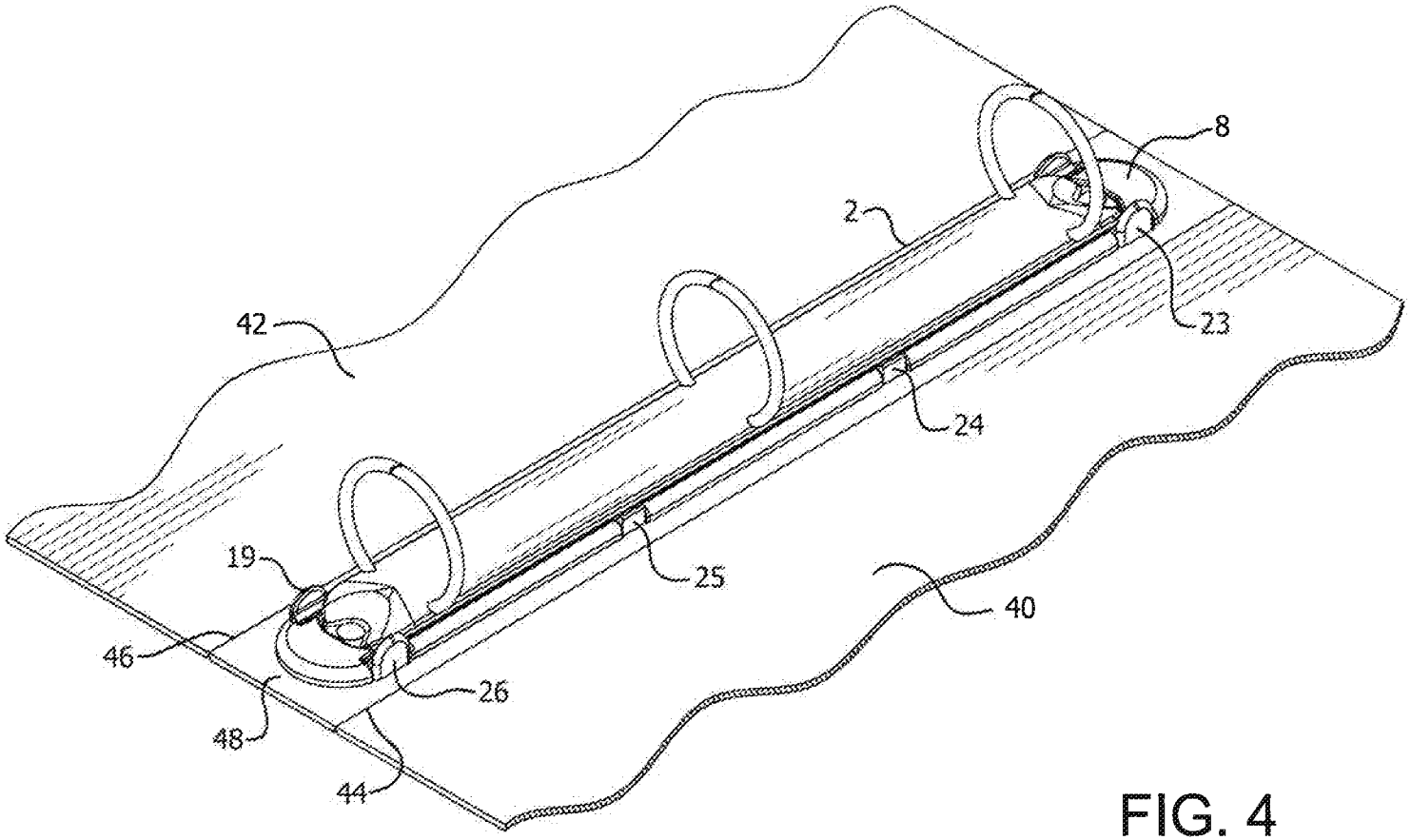
FIG. 4 is a close-up view of the ring binder components of the present invention, fully opened with its cover broken away.

The components of ring binder 1 of the present invention comprise a standard, spring loaded ring assembly 2 having ring housing 4 and upstanding rings 6. Ring assembly support 8 comprises a plurality of indents 9, 10, 11, 12, 13, 14, 15, and 16, located along the sides of the ring assembly support. Screws and nuts, rivets, or equivalent connecting devices 60 and 62 secure ring assembly support 8 beneath ring housing 4, such that ring housing 4 extends just short of the ends of the ring assembly support, i.e. between indents 9 and 16, and 12 and 13.

Additional components of the invention's ring binder include binder connector 18 and binder cover 28. Binder connector 18 comprises upstanding tabs 19, 20, 21, 22, 23, 24, 25 and 26. Binder cover 28 comprises top cover 40, bottom cover 42, and fold lines 44 and 46 connecting the top and bottom covers to center spine 48. Slots 29, 30, 31, 32, 33, 34, 35, and 36 extend through center spine 48.

Figure 5:
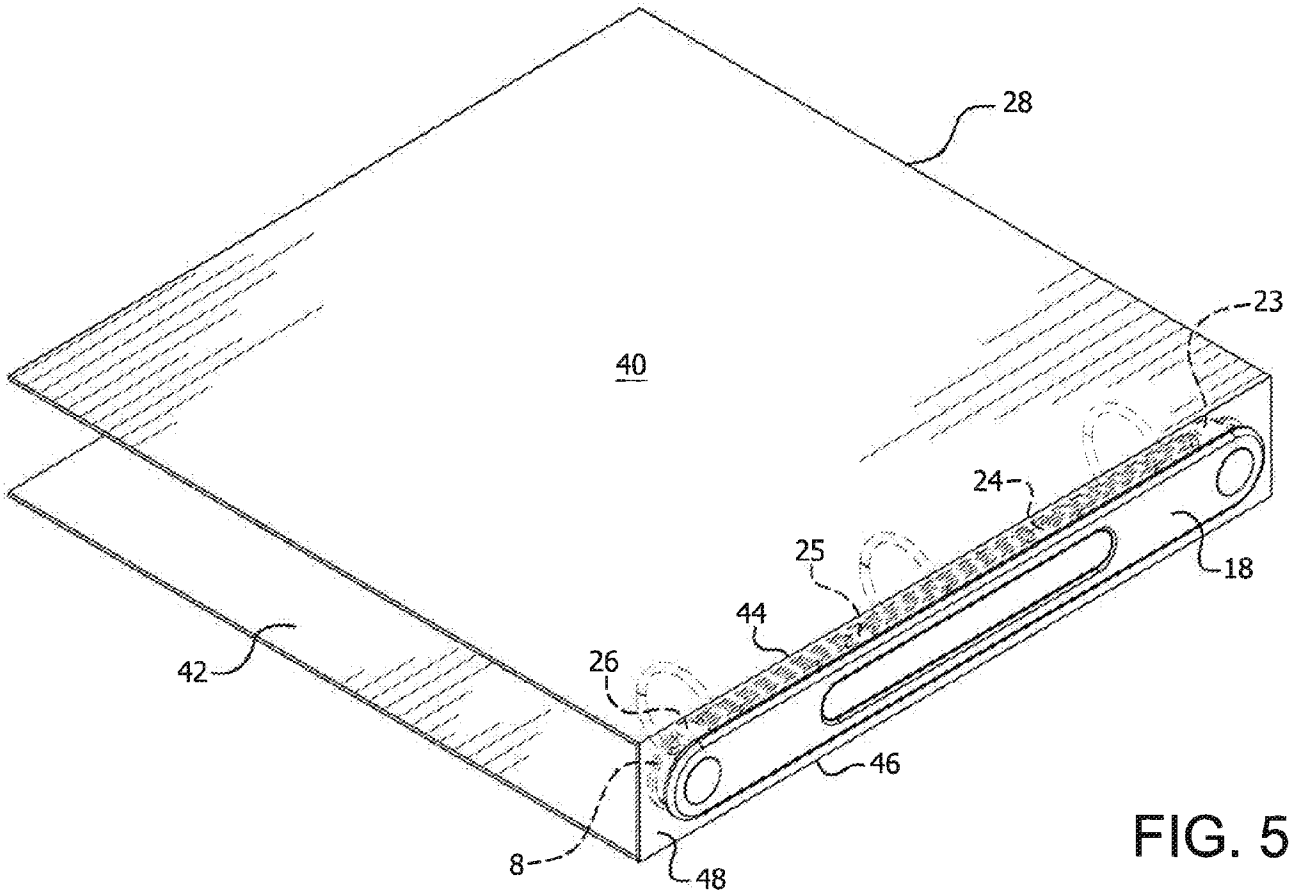
FIG. 5 is an assembled view of a closed ring binder of the present invention.

Ring binder 1 is easily and securely assembled first by utilizing a flat binder cover 28. Binder connector 18 is positioned adjacent to exterior surface 49 of center spine 48 of cover 28. Tabs 19-26 of the binder connector are then inserted into and through slots 29-36 of the center spine 48. Ring housing 4 with ring assembly support 8 secured thereto is then placed on interior surface 50 of center spine 48, such that tabs 19-26 of binder connector 18 are positioned within and then snapped into indents 9-16 of the ring assembly support. It is contemplated that ring assembly support 8 and binder connector 18 are constructed of a flexible, pliable plastic material. By this construction, tabs 19-26 of binder connector 18 can easily be inserted and snapped securely into indents 9-16 of ring assembly support 8. After binder connector 18 is so connected to ring assembly support 8, both overlaying center spine 48, top cover 40 and bottom cover 42 are folded along fold lines 44 and 46 with center spine 48 therebetween, as seen in FIG. 5. Ring binder 1 is now fully assembled for use.

When binder cover 28 needs to be replaced, due to wear or merely at the preference of the user who may desire a different color or alternate decorative binder cover, tabs 19-26 of binder connector 18 are simply and gently pulled out of indents 9-16 of ring assembly support 8. The difference in the degree of plastic material flexibility between binder connector 18 and ring assembly support 8 permits this relatively easy disengagement of the tabs from the indents. A new binder cover with slots 29-36 is then positioned between ring assembly support 8 and binder connector 18 to re-assemble the ring binder.

The components of the ring binder described herein can readily be sold as a replaceable binder kit, with several interchangeable binders. Manufacturing of the ring binder components themselves is economical, in that each component can be fabricated separately, with the binder covers stamped out as flat templates. This also results in efficient, and economical, space saving packaging and storage of the components, for more efficient shipment of the product.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A ring binder comprising:

a ring assembly having a ring base and upstanding rings;

a ring assembly support comprising a plurality of indents positioned on and inset within the side edges of the support;

means to connect the ring assembly above the ring assembly support;

a binder connector having a plurality of upstanding tabs, said binder connector being comprised of flexible, pliable material; and a binder cover with a center spine of given length having a plurality of slots configured to accept each of the plurality of binder connector tabs, whereby insertion of the binder connector tabs into the slots of the binder cover and into the indents of the ring assembly support forms an integral ring binder, the flexible, pliable binder connector being configured to allow the disconnection and removal of the binder connector from the binder cover and the insertion of the binder connector tabs into slots of different binder covers.

2. The ring binder as in claim 1 wherein one indent is located near each of the ends of the ring assembly support and one or more indents are located on the ring assembly support between the end indents.

3. The ring binder as in claim 1 wherein the means to connect are screw attachments.

4. The ring binder as in claim 1 wherein the binder connector extends along the length of the spine of the binder.

5. The ring binder as in claim 4 wherein the binder connector tabs extend up from the edges of and along the length of the binder connector.

6. The ring binder as in claim 1 wherein the binder connector tabs extend up from the edges of and along the length of the binder connector.

7. A ring binder kit with replaceable binder covers comprising:

a ring assembly having a ring base and upstanding rings;

a ring assembly support connected to the ring assembly and comprising a plurality of indents positioned on and inset within the side edges of the support;

a binder connector having a plurality of upstanding tabs, said binder connector being comprised of flexible, pliable material; and a plurality of binder covers, each having a center spine comprising a plurality of slots configured to accept each of the plurality of binder connector tabs, whereby any single one of the plurality of binder covers are used with the ring assembly, the ring assembly support, and the binder connector to form an assembled integral ring binder, the flexible, pliable binder connector being configured to allow the disconnection and removal of one of the plurality of binder covers and the insertion of the binder connector tabs into the slots of another of the plurality of binder covers to form a different assembled integral ring binder.

8. The kit as in claim 7 wherein one indent is located near each end of the ring assembly support and one or more indents are located on the ring assembly support between the end indents.

9. The kit as in claim 7 wherein the binder connector extends along the length of each of the center spines of the binder covers.

10. The kit as in claim 7 wherein the upstanding binder connector tabs extend up from the edges of and along the length of the binder connector.

* * * * *